US011499711B2

(12) United States Patent
Laforest

(10) Patent No.: US 11,499,711 B2
(45) Date of Patent: Nov. 15, 2022

(54) LIQUEFIED FUEL COMBUSTOR WITH INTEGRATED EVAPORATOR DEVICE AND ASSOCIATED METHOD

(71) Applicant: 8801541 CANADA INC., Sainte-Hedwige-de-Roberval (CA)

(72) Inventor: Luc Laforest, Roberval (CA)

(73) Assignee: 8801541 CANADA INC., Sainte-Hedwige-de-Roberval (CA)

( * ) Notice: Subject to any disclaimer, the term of this patent is extended or adjusted under 35 U.S.C. 154(b) by 0 days.

(21) Appl. No.: 16/815,968

(22) Filed: Mar. 11, 2020

(65) Prior Publication Data

US 2021/0003279 A1 Jan. 7, 2021

Related U.S. Application Data

(63) Continuation of application No. 15/804,769, filed on Nov. 6, 2017, now abandoned, which is a continuation of application No. 14/212,723, filed on Mar. 14, 2014, now abandoned.

(60) Provisional application No. 61/787,656, filed on Mar. 15, 2013.

(51) Int. Cl.
*F23D 11/44* (2006.01)

(52) U.S. Cl.
CPC ..... *F23D 11/443* (2013.01); *F23D 11/44* (2013.01); *F23D 11/441* (2013.01); *F23D 11/445* (2013.01)

(58) Field of Classification Search
CPC .... F23D 11/443; F23D 11/445; F23D 11/441; F23D 11/44
See application file for complete search history.

(56) References Cited

U.S. PATENT DOCUMENTS

| | | | | | |
|---|---|---|---|---|---|
| 4,318,689 | A * | 3/1982 | Forster | F23D 11/441 | 431/208 |
| 4,641,705 | A * | 2/1987 | Gorman | F28F 13/125 | 165/109.1 |
| 5,002,481 | A * | 3/1991 | Forster | F23D 11/443 | 431/208 |
| 5,464,006 | A * | 11/1995 | Ledjeff | F23C 13/00 | 122/14.1 |
| 6,010,544 | A * | 1/2000 | Haldeman | F02B 47/02 | 44/301 |
| 6,065,957 | A * | 5/2000 | Kondo | F23C 9/00 | 431/116 |
| 2009/0218083 | A1* | 9/2009 | Arnot | F28F 1/24 | 165/174 |
| 2011/0129393 | A1* | 6/2011 | Lecea | B01J 12/007 | 422/187 |
| 2014/0272733 | A1* | 9/2014 | Laforest | F23D 11/443 | 431/11 |

(Continued)

FOREIGN PATENT DOCUMENTS

EP 0661511 * 7/1995

*Primary Examiner* — Alfred Basichas

(57) ABSTRACT

The method can include injecting fuel from a liquefied fuel source into a combustion chamber having a combustion path, by circulating the fuel out from an inlet conduit into an evaporator housing, along the evaporator housing in a direction opposite the combustion path and across an evaporator element receiving fuel in the liquid state and exposing a multiplied surface of the liquid fuel to heat from the combustion path to evaporate the liquid fuel, and conveying the evaporated fuel into the combustion chamber and into the combustion path.

7 Claims, 4 Drawing Sheets

(56) References Cited

U.S. PATENT DOCUMENTS

2018/0292087 A1* 10/2018 Laforest ..... F23D 11/443

* cited by examiner 36
28
30
32
40
36

22
28
24
40
H

26

38
22
H
26

140
144
136
142

128
138
124
122
138

114
126

LIQUEFIED FUEL COMBUSTOR WITH INTEGRATED EVAPORATOR DEVICE AND ASSOCIATED METHOD

CROSS-REFERENCE TO RELATED INVENTIONS

This application claims the benefit provisional application No. 61/787,656, filed Mar. 15, 2013.

BACKGROUND OF THE INVENTION

Liquefied fuels (i.e. fuel that is stored in pressurized, liquefied form and evaporated from the liquid state into the gaseous state before combustion, such as propane, butane, natural gas, ethanol, etc.) are used in various applications. Many well-known, household applications use a fuel tank as an evaporator and rely on the fuel tank to feed the liquefied fuel in a pure gaseous form to a burner.

Some applications cannot rely solely on the use of the fuel tank as an evaporator, which poses a particular challenge in using liquefied fuels as a fuel source. There thus remained room for improvement.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

A liquefied fuel burner is provided which has an integrated evaporator having a housing provided inside a combustion chamber, and where the housing operates as a counter current heat exchanger with the surrounding flame to evaporate the fuel inside the housing.

In accordance with one aspect, there is provided a liquefied fuel combustor comprising: a combustion chamber having an intake, an exhaust, and a combustion path therebetween; an evaporation and injection device having: an evaporator housing provided inside the combustion chamber and extending along a portion of the combustion path and at least one evaporator outlet aperture to allow fuel out from the evaporator housing into the combustion chamber, an inlet conduit having an inlet end connectable to a liquefied fuel source outside the combustion chamber, an outlet end protruding inside the evaporator housing, and at least one evaporator inlet aperture associated to the outlet end, to allow fuel out from the inlet conduit into the evaporator housing; an evaporation path extending from the evaporator inlet aperture to the evaporator outlet aperture in a counter-current flow direction opposite to the combustion path aperture along at least a portion of the length of the housing; and an evaporation element positioned in the evaporation path, to receive fuel in the liquid state from the evaporator inlet aperture, and to expose a multiplied surface of the liquid fuel to heat from the combustion path for evaporation.

In accordance with another aspect, there is provided a method of injecting fuel from a liquefied fuel source into a combustion chamber having a combustion path, the method comprising circulating the fuel out from an inlet conduit into an evaporator housing, along the evaporator housing in a direction opposite the combustion path and across an evaporator element receiving fuel in the liquid state and exposing a multiplied surface of the liquid fuel to heat from the combustion path to evaporate the liquid fuel, and conveying the evaporated fuel into the combustion chamber and into the combustion path.

In accordance with another aspect, there is provided a fuel injector for evaporating liquid fuel as it is injected into a combustion chamber, the fuel injector comprising: an evaporation chamber having an evaporation section opposite an outlet section, the evaporation chamber having a closed wall with a plurality of outlet apertures provided at the outlet section; metal strands housed in the evaporation section of the evaporation chamber; an inlet having an inlet end connectable to a source of the liquid fuel, and an injector tube penetrating into the evaporation chamber and leading to the evaporation section, the inlet having an orifice forming a spray nozzle in the inlet end and leading to the evaporation section across the injector tube.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
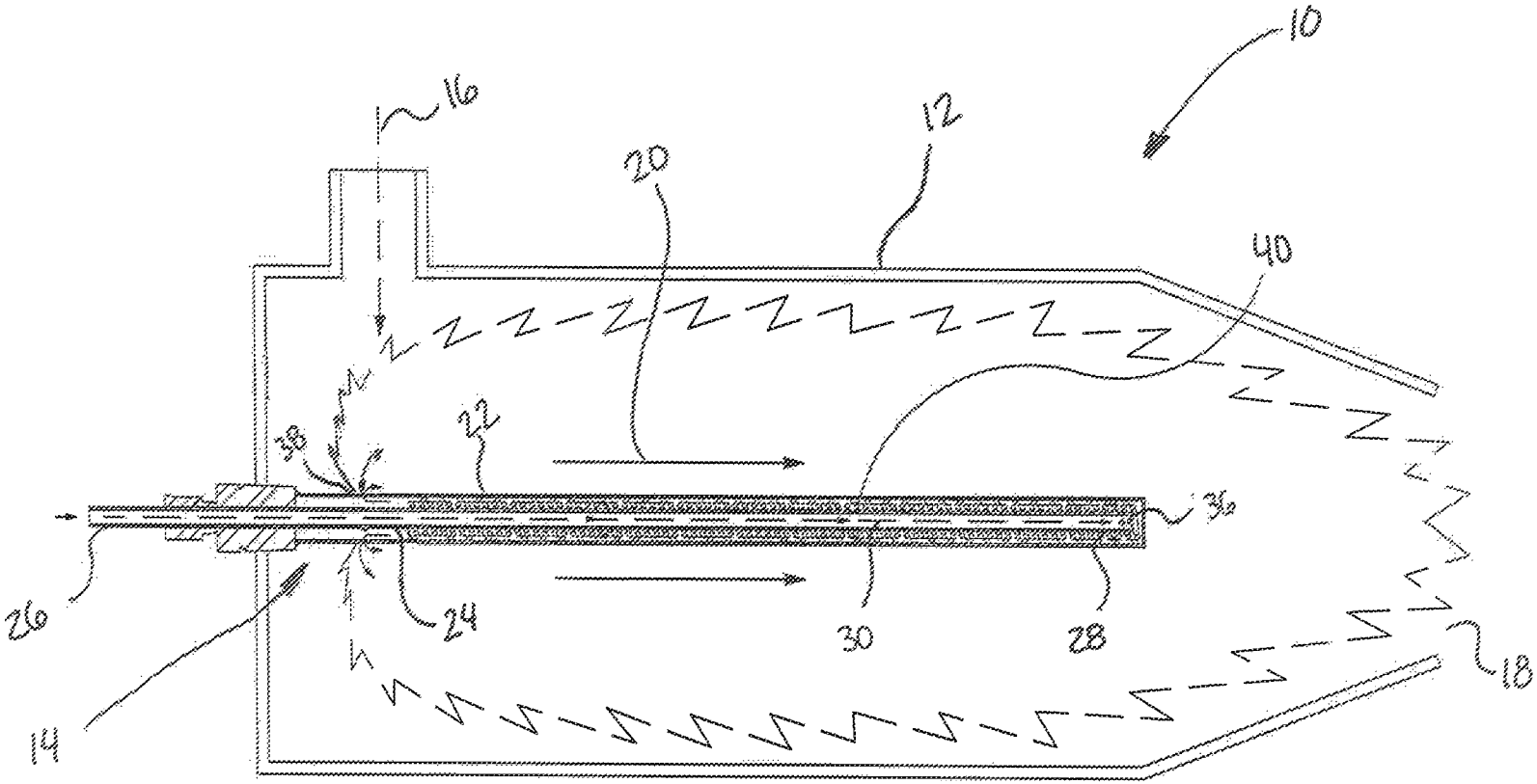
FIG. 1 is an axial cross-sectional view of an example of a combustor.
Figures 2, 2A, 3, 3A:
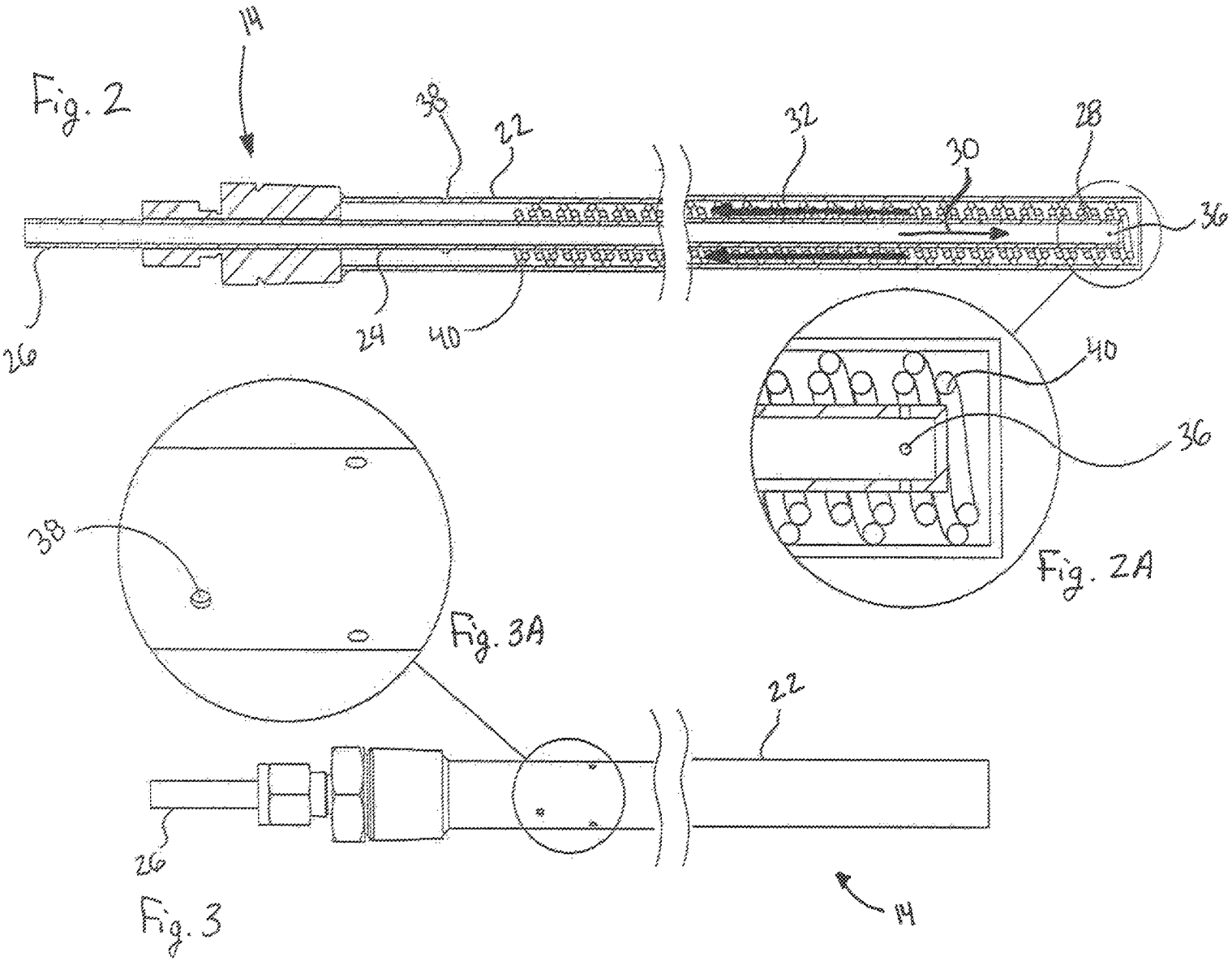
FIG. 2 is an axial cross-sectional view of an evaporation and injection device of the combustor of FIG. 1, with FIG. 2A being an enlarged portion thereof.
FIG. 3 is side elevational view of the evaporation and injection device of FIG. 2, with FIG. 3A being an enlarged portion thereof.

FIG. 1 shows an example of a combustor 10 generally having a combustion chamber 12 and an evaporation and injection device 14. The combustion chamber 12 has an intake 16 at one end and an exhaust 18 at the other end. A combustion path 20 can be generally defined as extending from the intake 16 to the exhaust 18 of the combustion chamber 12. The evaporation and injection device 14 generally has an evaporator housing 22 protruding into the combustion chamber 12 along a portion of the combustion path 20, and an inlet conduit 24, provided here in the form of a tube, having an inlet end 26 connectable to a liquefied fuel source externally to the combustion chamber and an outlet end 28 protruding inside the evaporator housing 22. The outlet end 28 can have one or more apertures to allow the fuel out of the inlet conduit 24 and into the evaporation area between the evaporator housing 22 and the inlet conduit 24. The evaporator housing 22 also has one or more apertures to allow evaporated fuel out of the evaporator housing 22 and into the combustion chamber 12 for combustion. Accordingly, a fuel supply path 30 can be defined as extending between the inlet 26 and the outlet 28 of the inlet conduit 24, and an evaporation path 32 (shown in FIG. 2) can be defined between the outlet 28 of the inlet conduit 24 and the outlet of the evaporator housing 22.

It will be noted here that the evaporation path 32 is separated from the combustion chamber 12 by the wall of the evaporator housing 22 which, in this case, is conveniently made of a material having high heat resistance and high heat conductivity, such as stainless steel for instance, to allow the evaporator housing 22 to both withstand the heat prevailing in the combustion chamber 12 during use and favour heat transfer between the combustion chamber 12 and the fuel circulating in the evaporation path 32. Moreover, it will be noted that the evaporation path 32 is directed opposite to the combustion path 20 and can thus be said to form a counter-current flow heat exchanger therewith.

For the sake of simplicity and convenience, the aperture(s) at the outlet end 28 of the inlet conduit 24 will be referred to as evaporator inlet aperture(s) 36 and the aperture(s) forming the outlet of the evaporator housing 22 will be referred to as evaporator outlet aperture(s) hereinafter.

An evaporation element 40 is positioned in the evaporation path 32. The exact construction of the evaporation element 40 can vary, and it can be adapted to play either one or both of the following functions: 1) multiplying the exposed surface of liquid fuel to increase the evaporation rate and 2) causing drag or otherwise straining the flow of liquid along the evaporation path 32 to provide more time for the evaporation to occur. As a result of one, or both of these functions, combined with the heat exchanger function of the configuration of the combustor as a whole, fuel being in the liquid state at the evaporator inlet apertures 36 can be efficiently evaporated into the gaseous state and the resulting arrangement can be considered relatively simple and be achieved at a satisfactorily low cost.

In this particular embodiment, the combustor 10 is generally tubular, as well as the injector and evaporator device 14 which is further provided concentrically therein. The inlet conduit 24 penetrates deep into the evaporator housing 22 and the evaporator outlet apertures 38 are well recessed from the evaporator inlet apertures 36. Both the evaporator outlet apertures 38 and the evaporator inlet apertures 36 are oriented radially. The evaporation element 40 is provided here in the form of two or more intertwined helical springs of stainless steel having a satisfactorily resistant gauge stretched along the evaporator housing 22. In alternate embodiments, many of the latter design considerations can vary while still achieving satisfactory results. In particular, the shape of the evaporator conduit can be adapted to the shape of the flame. Although the transversal cross-sectional shape can have another geometric shape than a circle, a circular shape can be preferred for various reasons, such as the ability to fill it with a suitable evaporation element 40 (which can be one or more helical springs, wire mesh, or any other suitable alternative for instance) and heat transfer considerations. It will be noted here that although the depicted liquefied fuel combustor described above is provided with a relatively high capacity to evaporate fuel in liquid state, the fuel fed to it does not necessarily have to be in the liquid state and it can handle many different ratios of liquid vs. gaseous state at the evaporation inlet in a satisfactory manner.

Figure 4:
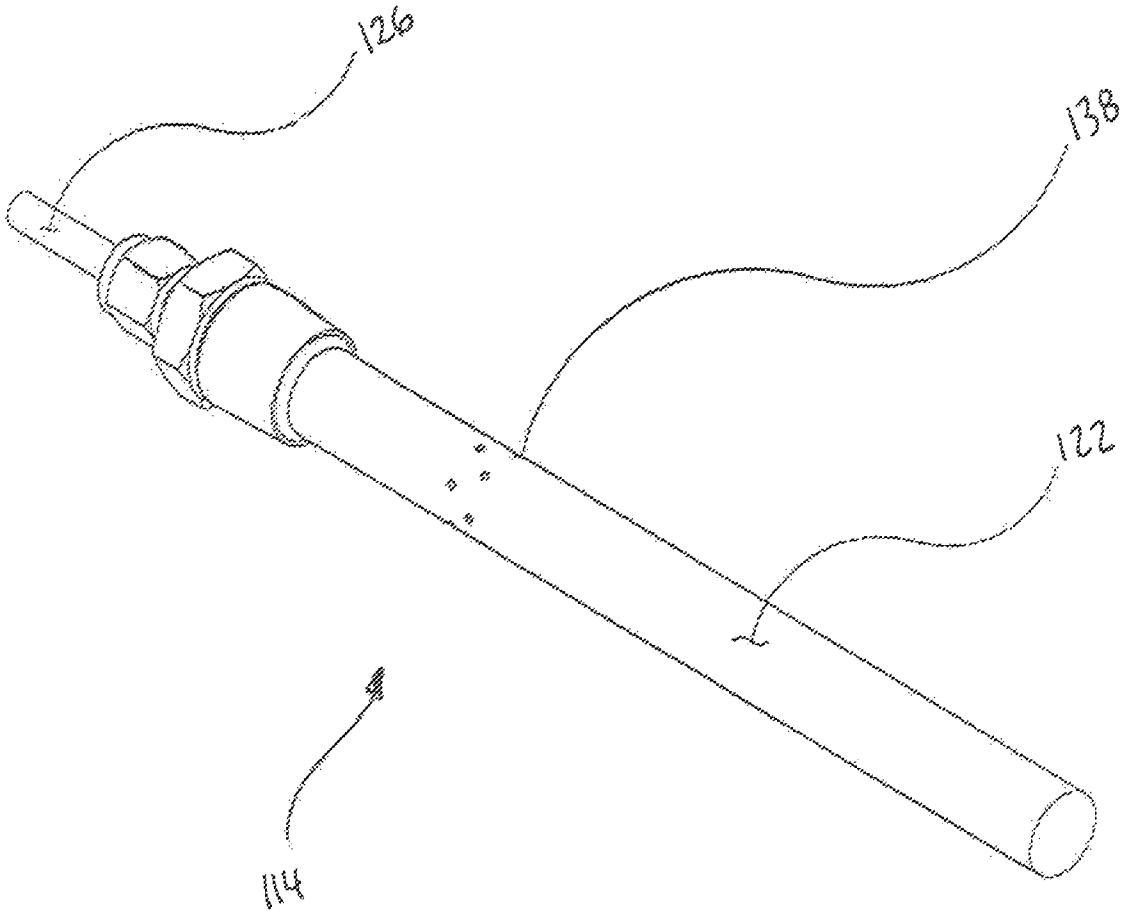
FIG. 4 is an oblique view of another embodiment of an evaporation and injection device for a combustor.
Figures 5, 5A, 5B:
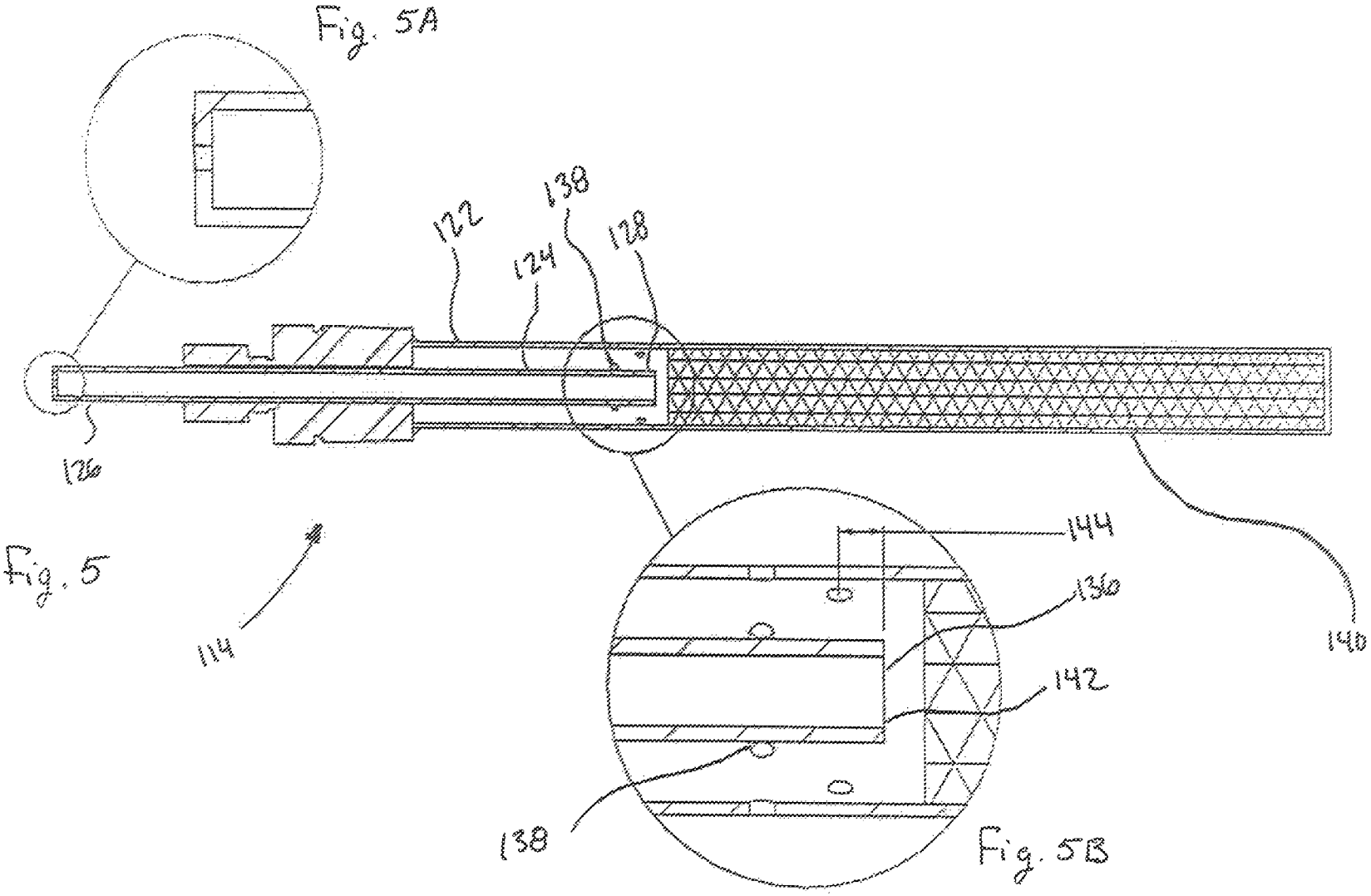
FIG. 5 is an axial cross-sectional view of the evaporation and injection device of FIG. 4, with FIGS. 5A and 5B being enlarged portions thereof.

FIGS. 4 through 5B illustrate another embodiment of an injector and evaporator device 114. The general construction of this other embodiment is relatively similar to the one described above, but the internal workings are somewhat different. In this embodiment, the outlet end 128 of the inlet conduit 124 only partially penetrates into the evaporation housing 122 and has an axial outlet 142 oriented to inject or spray the fuel into the evaporation element 140, provided here in the form of a wire mesh. The evaporation outlet apertures 138 are provided here recessed from the evaporation inlet aperture 136 by a given axial distance 144 to reduce the likelihood of liquid escaping into the combustion chamber unevaporated be it by splashing or other reason.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A liquefied fuel combustor comprising:

a combustion chamber having an intake, an exhaust, and a combustion path therebetween;

an evaporation and injection device having:

an evaporator housing provided inside the combustion chamber and extending along a portion of the combustion path and at least one evaporator outlet aperture to allow fuel out from the evaporator housing into the combustion chamber;

an inlet conduit having an inlet end connectable to a liquefied fuel source outside the combustion chamber, an outlet end protruding inside the evaporator housing, and at least one evaporator inlet aperture associated to the outlet end, to allow fuel out from the inlet conduit into the evaporator housing;

an evaporation path extending from the evaporator inlet aperture to the evaporator outlet aperture in a counter-current flow direction opposite to the combustion path aperture along at least a portion of the length of the housing; and an evaporation element positioned in the evaporation path, to receive fuel in the liquid state from the evaporator inlet aperture, and to expose a multiplied surface of the liquid fuel to heat from the combustion path for evaporation;

wherein the evaporation element includes a plurality of elongated metal strands; and wherein the elongated metal strands are in the form of at least one helical spring stretched along the length of the evaporator housing.

2. The liquefied fuel combustor of claim 1 wherein the evaporator housing is elongated and concentric to the combustion chamber.

3. The liquefied fuel combustor of claim 2 wherein the inlet conduit is elongated and concentric to the evaporator housing.

4. The liquefied fuel combustor of claim 1 wherein the at least one evaporator inlet aperture includes a plurality of apertures oriented radially across the outlet end of the inlet conduit.

5. The liquefied fuel combustor of claim 1 wherein the at least one evaporator outlet aperture includes a plurality of apertures oriented radially across the evaporator housing.

6. A fuel injector for evaporating liquid fuel as it is injected into a combustion chamber of a liquefied fuel combustor according to claim 1, the fuel injector comprising:

an evaporation chamber having an evaporation section opposite an outlet section, the evaporation chamber having a closed wall with a plurality of outlet apertures provided at the outlet section;

metal strands housed in the evaporation section of the evaporation chamber;

an inlet having an inlet end connectable to a source of the liquid fuel, and an injector tube penetrating into the evaporation chamber and leading to the evaporation section, the inlet having an orifice forming a spray nozzle in the inlet end and leading to the evaporation section across the injector tube.

7. A liquefied fuel combustor comprising:

a combustion chamber having an intake, an exhaust, and a combustion path therebetween;

an evaporation and injection device having:

an evaporator housing provided inside the combustion chamber and extending along a portion of the combustion path and at least one evaporator outlet aperture to allow fuel out from the evaporator housing into the combustion chamber;

an inlet conduit having an inlet end connectable to a liquefied fuel source outside the combustion chamber, an outlet end protruding inside the evaporator housing, and at least one evaporator inlet aperture associated to the outlet end, to allow fuel out from the inlet conduit into the evaporator housing;

an evaporation path extending from the evaporator inlet aperture to the evaporator outlet aperture in a counter-current flow direction opposite to the combustion path aperture along at least a portion of the length of the housing; and an evaporation element positioned in the evaporation path, to receive fuel in the liquid state from the evaporator inlet aperture, and to expose a multiplied surface of the liquid fuel to heat from the combustion path for evaporation;

wherein the evaporator housing is elongated and concentric to the combustion chamber;

wherein the inlet conduit is elongated and concentric to the evaporator housing;

wherein the at least one evaporator inlet aperture includes a plurality of apertures oriented radially across the outlet end of the inlet conduit;

wherein the at least one evaporator outlet aperture includes a plurality of apertures oriented radially across the evaporator housing;

wherein the evaporation element includes a plurality of elongated metal strands; and wherein the elongated metal strands are in the form of at least one helical spring stretched along the length of the evaporator housing.

* * * * *